US008682222B2

(12) United States Patent
Kidaka

(10) Patent No.: US 8,682,222 B2
(45) Date of Patent: Mar. 25, 2014

(54) CHARGING DEVICE HAVING A SHIELDING MEMBER

(71) Applicant: Canon Kabushiki Kaisha, Tokyo (JP)

(72) Inventor: Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/770,860

(22) Filed: Feb. 19, 2013

(65) Prior Publication Data

US 2013/0164036 A1 Jun. 27, 2013

Related U.S. Application Data

(62) Division of application No. 13/032,485, filed on Feb. 22, 2011, now Pat. No. 8,521,054.

(51) Int. Cl.
*G03G 15/02* (2006.01)

(52) U.S. Cl.
USPC ..... 399/172; 399/100

(58) Field of Classification Search
USPC ..... 399/115, 168, 170–173, 100
See application file for complete search history.

(56) References Cited

U.S. PATENT DOCUMENTS

| | | | | |
|---|---|---|---|---|
| 5,351,111 | A * | 9/1994 | Takafuji et al. | 399/171 |
| 5,504,560 | A | 4/1996 | Kitagaki et al. | |
| 5,870,657 | A | 2/1999 | Nagame et al. | |
| 7,289,746 | B2 | 10/2007 | Yamada et al. | |
| 7,711,284 | B2 | 5/2010 | Ichikawa et al. | |
| 2008/0038011 | A1 | 2/2008 | Nakajima et al. | |
| 2009/0136253 | A1 | 5/2009 | Nakajima et al. | |
| 2009/0136261 | A1 * | 5/2009 | Hayashi et al. | 399/171 |
| 2010/0322668 | A1 | 12/2010 | Takishita | |
| 2011/0222897 | A1 | 9/2011 | Makino | |
| 2011/0222901 | A1 | 9/2011 | Makino | |
| 2011/0222909 | A1 | 9/2011 | Kidaka | |

FOREIGN PATENT DOCUMENTS

| | | | |
|---|---|---|---|
| CN | 101122765 | A | 2/2008 |
| EP | 2071411 | A1 | 6/2009 |
| EP | 2264549 | A1 | 12/2010 |
| JP | 7-104564 | A | 4/1995 |
| JP | 2001-13763 | A | 1/2001 |
| JP | 2003-76118 | A | 3/2003 |
| JP | 2007-72212 | A | 3/2007 |
| JP | 2008-145851 | A | 6/2008 |
| JP | 2009-103999 | A | 5/2009 |
| JP | 2009-128617 | A | 6/2009 |

OTHER PUBLICATIONS

Search Report dated Jun. 28, 2011 in European Application No. 11156735.0.
Chinese Office Action dated May 29, 2013 in Chinese Application No. 201110057233.1.
Chinese Office Action dated Nov. 27, 2013 in Chinese Application No. 201110057233.1.

* cited by examiner

*Primary Examiner* — G. M. Hyder
(74) *Attorney, Agent, or Firm* — Fitzpatrick, Cella, Harper and Scinto

(57) ABSTRACT

The present invention provides a charging device which can suppress the deterioration of a photosensitive member and the occurrence of an image deletion phenomenon on an electrophotographic image due to an electric discharge product having deposited on a charger shutter, even when having been used for a long period of time. The charging device has an image bearing member which bears an image thereon, a charging member which charges the image bearing member, and a shielding member which shields the charging member from the image bearing member, wherein the shielding member includes a specific material.

6 Claims, 7 Drawing Sheets

CHARGING DEVICE HAVING A SHIELDING MEMBER

This application is a divisional of application Ser. No. 13/032,485, filed Feb. 22, 2011, the contents of which are incorporated herein by reference.

BACKGROUND OF THE INVENTION

1. Field of the Invention

The present invention relates to a charging device used in an image forming apparatus with the use of an electrophotographic system.

2. Description of the Related Art

Japanese Patent Application Laid-Open No. 2007-072212 discloses a technology of suppressing increase in the amount of a deposited electric discharge product on a charger shutter by making the charger shutter contain a photocatalytic substance, and irradiating the charger shutter having the electric discharge product deposited thereon with a light which causes a photocatalytic reaction to thereby decompose the electric discharge product. Japanese Patent Application Laid-Open No. H07-104564 discloses a charger shutter which uses a stainless steel containing 2 to 20 wt % or more of nickel (Ni) for the charger shutter; and describes that the charger shutter thereby makes nitric acid or a nitrate ion which is an electric discharge product combine with Ni to form a metal salt, makes the stainless steel form a passive state thereon against nitric acid, and can improve an image deletion phenomenon even when the electric discharge product has deposited on the charger shutter.

However, in the configuration according to Patent Japanese Patent Application Laid-Open No. 2007-072212, the charger shutter having the electric discharge product deposited thereon is irradiated with the light which causes the photocatalytic reaction, and accordingly the charging device needs a space into which the charger shutter retreats from underneath the corona charger, and needs to provide a light source therein having such a wavelength component as to excite the photocatalytic substance. Usually, when a tabular charger shutter is moved in a sub-scan direction, there is a pre-exposure (discharging member) region in the upstream side of the corona charger and there is an image exposure region in the downstream side. Therefore, in order to configure the evacuation space and the light source while avoiding those regions, the arrangement of the devices is complicated, which may result in an increase in costs.

As for the configuration according to Patent Japanese Patent Application Laid-Open No. H07-104564, since the passivated nickel hardly forms a metal salt with nitric acid or a nitrate ion, the nitric acid produced on the charger shutter gradually becomes hard to convert into the metal salt.

According to the investigation by the present inventors, the charger shutter according to Japanese Patent Application Laid-Open No. H07-104564 had some cases in which the nitric acid that was not converted into the metal salt resulted in remaining on the surface of the charger shutter for a long period of time, the nitric acid migrated to a photosensitive member or caused image deletion and the improvement effect could not be fully obtained for the problem that the image deletion phenomenon occurred in an electrophotographic image due to the electric discharge product.

For this reason, the present invention is directed to provide a charging device which can suppress the influence that an electric discharge product having deposited on the charger shutter gives to a photosensitive member for a long period of time, and as a result, can suppress the deterioration of the photosensitive member and the occurrence of the image deletion phenomenon on an electrophotographic image, for a long period of time.

SUMMARY OF THE INVENTION

According to one aspect of the present invention, there is provided a charging device comprising an image bearing member which bears an image thereon, a charging member which charges the image bearing member and a shielding member which shields between said image bearing member from said charging member, wherein said shielding member comprises a fiber having an official moisture regain of 2.0% or more and 15.0% or less.

According to another aspect of the present invention, there is provided a charging device comprising an image bearing member which bears an image thereon, a charging member which charges said image bearing member, and a shielding member which shields between said image bearing member from said charging member, wherein said shielding member comprises any one material selected from the group consisting of the following (i) to (iv): (i) a metal or an alloy which can produce a metal salt by combining with a nitrate ion; (ii) a metal hydroxide; (iii) a metal sulfide; and (iv) phosphorus or a phosphate ester.

The present invention can provide an image forming apparatus which can prevent an electric discharge product having deposited on a charger shutter from migrating to a photosensitive member and can reduce or prevent the deterioration of the photosensitive member and the occurrence of the image deletion phenomenon, even when having been used for a long period of time.

Further features of the present invention will become apparent from the following description of exemplary embodiments with reference to the attached drawings.

DESCRIPTION OF THE EMBODIMENTS

Figure 1:
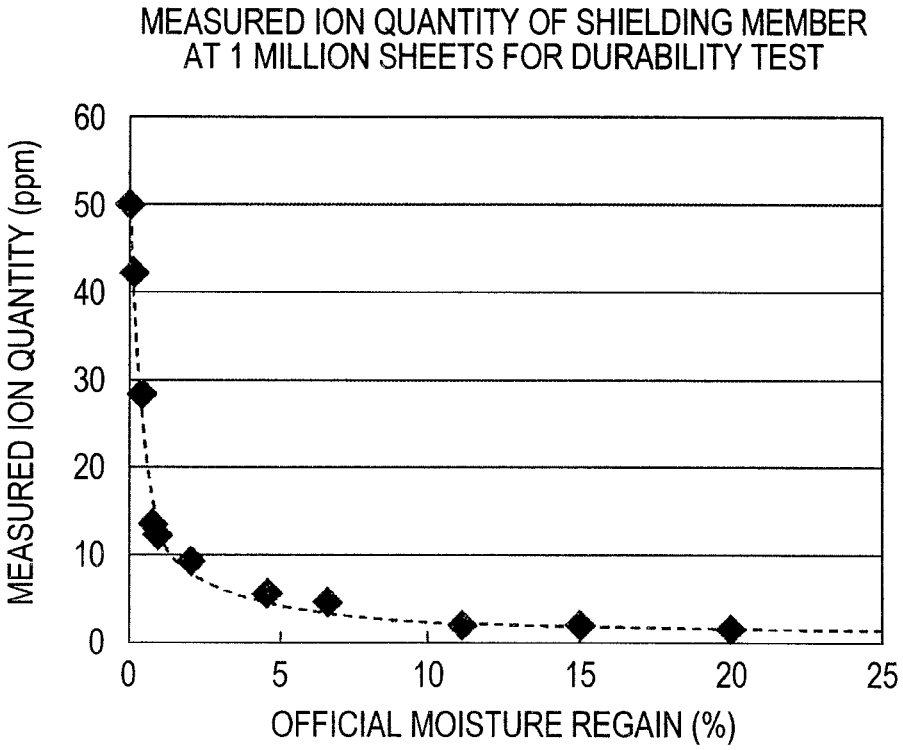
FIG. 1 is a graph illustrating a relationship between an official moisture regain of a charger shutter material and an ion quantity originating from an electric discharge product according to Experimental Example 1.

Preferred embodiments of the present invention will now be described in detail in accordance with the accompanying drawings.

The charging device according to the present invention will be described in detail below.

A charging device according to one aspect of the present invention has a charger shutter between an image bearing member which bears an image thereon and a charging member which charges the image bearing member, as a shielding member. The charger shutter includes a fiber having an official moisture regain of 2.0% or more and 15.0% or less. The official moisture regain is based on the specification of Japanese Industrial Standards (JIS) L 0105:2006 (General principles of physical testing methods for textiles).

Among nitrogen oxides (NOx) which are electric discharge products, particularly nitrogen dioxide ($No_2$) and dinitrogen pentoxide ($N_2O_5$) easily dissolve in water. By making the charger shutter include the fiber having an official moisture regain of 2.0% or more and 15.0% or less, the amount of the water content contained in the charger shutter increases. As a result, the nitrogen oxide (NOx) reacts not only with the surface of the charger shutter but also with water which has permeated into the inner part thereof to produce nitric acid. As a result, it is considered that the amount of nitric acid to be produced on the surface of the charger shutter decreases, and that the amount of nitric acid to migrate to a photosensitive member can be reduced.

In addition, the fiber having an official moisture regain of 15.0% or less little swells and deforms even when the water content in the inner part has increased. By making the charger shutter include the fiber having the above described official moisture regain, the surface area of the charger shutter increases. As a result, the amount of adsorbed water increases, and at the same time, the area of the charger shutter to contact the nitrogen oxide (NOx) also increases. Accordingly, the fiber can continue the production of the nitric acid in the inner part of the charger shutter for a long period of time.

Cellulose can be used as the fiber having an official moisture regain of 2.0% or more and 15.0% or less. Cellulose has high hygroscopicity and a porous structure. In other words, cellulose contains water not only on the surface but also in the inner part, and water in the cellulose reacts with the nitrogen oxide (NOx) to easily produce nitric acid also in the inner part of the cellulose. Accordingly, in the charger shutter including the cellulose, the adsorbing action of the electric discharge product continues for a long period of time.

Cellulose also has relatively lower chemical stability compared to other synthetic resins. Specifically, cellulose has relatively lower acid resistance compared to other synthetic resins, and easily dissolves in nitric acid. Accordingly, it is considered that the nitric acid produced on the charger shutter is consumed for the decomposition of the cellulose in the charger shutter including the cellulose, and therefore the amount of the nitric acid remaining on the charger shutter decreases. It is considered that the charger shutter according to the present aspect shows an effect according to the present invention due to the superposed effect of these actions.

Among celluloses according to the present invention, cotton, an acetate fiber and viscose rayon can be particularly used. These substances hardly swell and deform even when the water content in the inner part has increased, and their strengths also hardly vary, which can consequently stabilize a shielded region of the charger shutter for a long period of time.

Next, a charging device according to another aspect of the present invention has an image bearing member which bears an image thereon, a charging member which charges the image bearing member, and a charger shutter including any one material selected from the group consisting of the following (i) to (iv) as a shielding member which shields the charging member from the image bearing member.

(i) A metal or an alloy which can produce a metal salt by combining with a nitrate ion;

(ii) A metal hydroxide;

(iii) A metal sulfide; and (iv) Phosphorus or a phosphate ester.

The materials will be sequentially described below.

(i) The nitric acid which has been produced on the surface of a charger shutter including a metal or an alloy that can produce a metal salt by combining with a nitrate ion immediately combines with the metal or the alloy to produce the metal salt. Accordingly, the nitric acid hardly remains on the surface of the charger shutter in a form of nitric acid for a long period of time. It is considered that for this reason, the charger shutter can effectively suppress the migration of nitric acid to a photosensitive member and the occurrence of the image deletion of an electrophotographic image originating from the migration, for a long period of time.

Specific examples of the above described metal or alloy which can produce the metal salt by combining with the nitrate ion include aluminum, zinc, tin, lead, copper, brass and bronze.

Among the metals which can produce the metal salt by combining with the nitric acid, there are some metals which form a passive state against nitric acid. Such metals include iron, nickel, aluminum and chromium. Because it is recognized that such a metal substantially does not dissolve in nitric acid, the metal is basically unsuitable as the metal or the alloy according to the above described (i).

However, it was proved from an investigation by the present inventors that aluminum hardly forms the passive state among the above described metals which form the passive state, particularly in a high humidity environment, and can produce the metal salt by reacting with nitric acid in a long period of time. The passivation means a state in which aluminum nitrate produced by the reaction of concentrated nitric acid with aluminum forms the passive state on the surface, the passive state does not dissolve in the concentrated nitric acid, accordingly a new surface does not appear, and the dissolution stops. It is considered that aluminum nitrate is a substance which dissolves in water very well, accordingly forms a state of hardly forming the passive state because water supplied from the air always intervenes in a high humidity environment, and dissolves in water. The other metals (iron, nickel and chromium) which form the passive state also become a state of being relatively hard to form the passive state in a high humidity environment, but aluminum remarkably shows the tendency. Accordingly, aluminum is included in the metal according to the above described (i) of the present invention.

(ii) The metal hydroxide is generally difficult to dissolve in water but dissolves in nitric acid. Specifically, because the metal hydroxide included in the charger shutter is hardly oxidized even by water which is supplied from the air in a high humidity environment, the reactivity with nitric acid is kept for a long period of time. In other words, the metal hydroxide in the charger shutter can produce the metal salt by reacting with nitric acid produced on the charger shutter, for a long period of time. Accordingly, it is considered that the charger shutter including the metal hydroxide can effectively suppress the migration of the nitric acid which is the electric discharge product, to the photosensitive member for a long period of time.

Materials particularly suitable for the metal hydroxide include aluminum hydroxide, zinc hydroxide, tin hydroxide, lead hydroxide and copper hydroxide. These metal hydroxides more efficiently react with nitric acid to produce the metal salt. This is considered to be because the above described metal hydroxides have the above described properties and further have a metal composition of easily producing the metal salt by combining with the nitrate ion. In other words, the charger shutter including the above described metal hydroxide can more efficiently convert the nitric acid produced on the charger shutter into the metal salt. Accordingly, the charger shutter can further alleviate an influence which the nitric acid gives to the photosensitive member.

(iii) The metal sulfide is generally difficult to dissolve in water but dissolves in nitric acid. Specifically, because the metal sulfide included in the charger shutter is hardly oxidized even by water which is supplied from the air in a high humidity environment, the reactivity with the nitric acid is kept for a long period of time. In other words, the metal sulfide in the charger shutter can produce the metal salt by reacting with nitric acid produced on the charger shutter, for a long period of time. Accordingly, it is considered that the charger shutter including the metal sulfide can effectively suppress the migration of the nitric acid to the photosensitive member for a long period of time.

Materials particularly suitable for the metal sulfide include aluminum sulfide, zinc sulfide, tin sulfide, lead sulfide and copper sulfide.

Among the above described metal sulfides, zinc sulfide, tin sulfide, the lead sulfide and copper sulfide more efficiently react with the nitric acid to produce the metal salt. This is considered to be because these metal sulfides have the above described properties as metal sulfides and further easily produce the metal salt by combining with the nitrate ion. In other words, the charger shutter including the above described metal sulfide can more efficiently convert the nitric acid produced on the charger shutter into the metal salt.

On the other hand, among the above described metal sulfides, aluminum sulfide has properties different from general properties of the metal sulfides, and changes to aluminum hydroxide by being hydrolyzed in a high humidity environment. As a result, it is considered that the charger shutter can alleviate various influences which the nitric acid gives to the photosensitive member from the same reason as that of the metal hydroxide described in the above described (ii).

(iv) Phosphorus or the phosphate ester is considered to react with the nitric acid to produce phosphoric acid, polymetaphosphoric acid and the like. Accordingly, it is considered that in the charger shutter including these materials, water is produced by a dehydration reaction with the molecular chain, and the nitrogen oxide (NOx) exists not only on the surface of the charger shutter but also permeates into the inner part of the charger shutter to produce nitric acid. It is considered that as a result, the capability of absorbing the nitric acid continues for a long period of time, and the charger shutter can alleviate various influences which the nitric acid gives to the photosensitive member. Red phosphorus having high reactivity with nitric acid can be particularly used as the above described phosphorus.

Whole configuration of image forming apparatus

Next, the whole configuration will be described below with reference to FIG. 2, while taking a laser beam printer which adopts an electrophotographic system as an image forming apparatus according to the present invention as an example. After that, a charging device will be described in detail.

Figure 2:
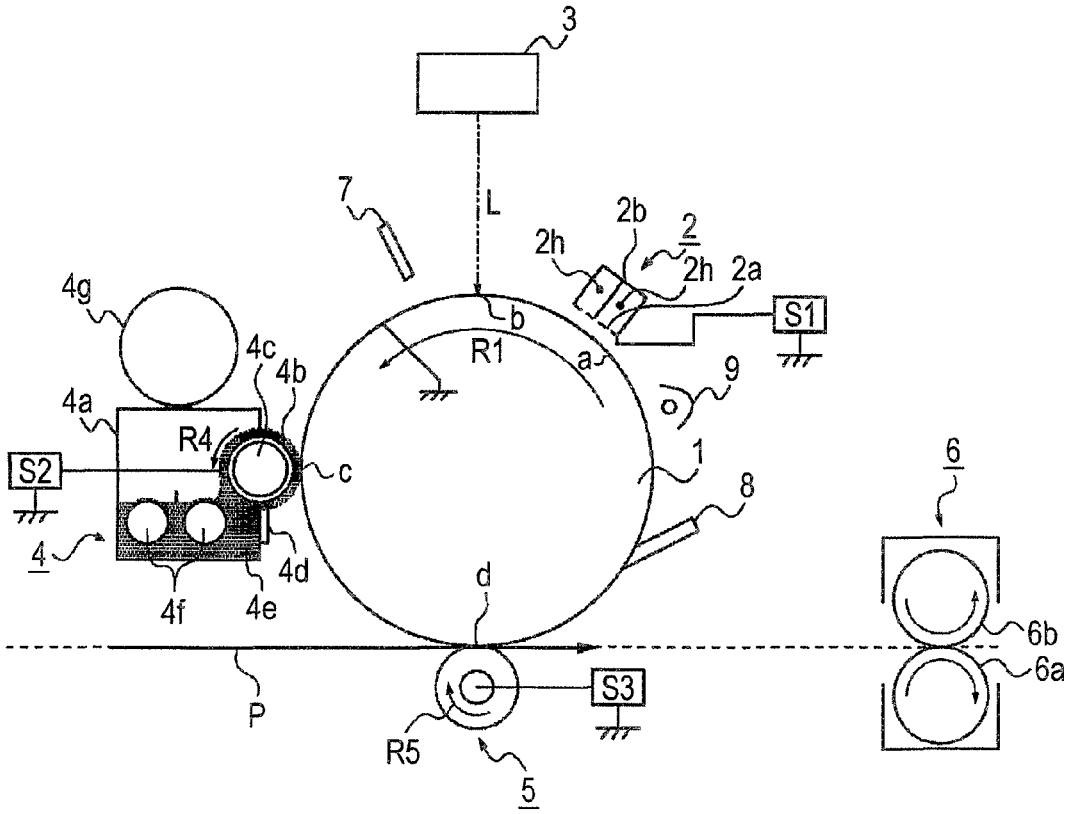
FIG. 2 is a schematic sectional view of an image forming apparatus.

As illustrated in FIG. 2, a charging device 2, an exposure device 3, a potential-measuring device 7, a developing device 4, a transfer device 5, a cleaning device 8, and an optical discharging device 9 are disposed in this order around a photosensitive member (image bearing member) along the rotative direction thereof (in a direction indicated by an arrow R1). In addition, a fixing device 6 is disposed in the downstream side of the transfer device 5 in a direction in which a recording material P is transported. Next, individual image forming devices associated with image formation will be sequentially described in detail.

Photosensitive Member

The photosensitive member 1 as the image bearing member is a cylindrical (drum type) electrophotographic photosensitive member having a photosensitive layer which is a negatively chargeable organic optical semiconductor. The photosensitive member 1 has the diameter of 84 mm and is rotationally driven in the direction of the arrow R1 around a center shaft (not illustrated) at a process speed (peripheral speed) of 500 mm/sec.

Charging Device

The charging device 2 is a corona charger of a scorotron type, which has an electric discharge wire 2*h*, a U-shaped electroconductive shield 2*b* provided so as to surround the electric discharge wire and a grid electrode 2*a* provided at an opening of the shield 2*b*. The corona charger to be used has also two electric discharge wires 2*h* so as to cope with a speedup of image formation, and also in order to cope with the speedup, has a partition wall provided so that the shield 2*b* blocks the two electric discharge wires 2*h* from each other. The corona charger 2 is provided along a generatrix of the photosensitive member 1, and the longitudinal direction of the corona charger 2 is parallel to a shaft direction of the photosensitive member 1.

Figure 10:
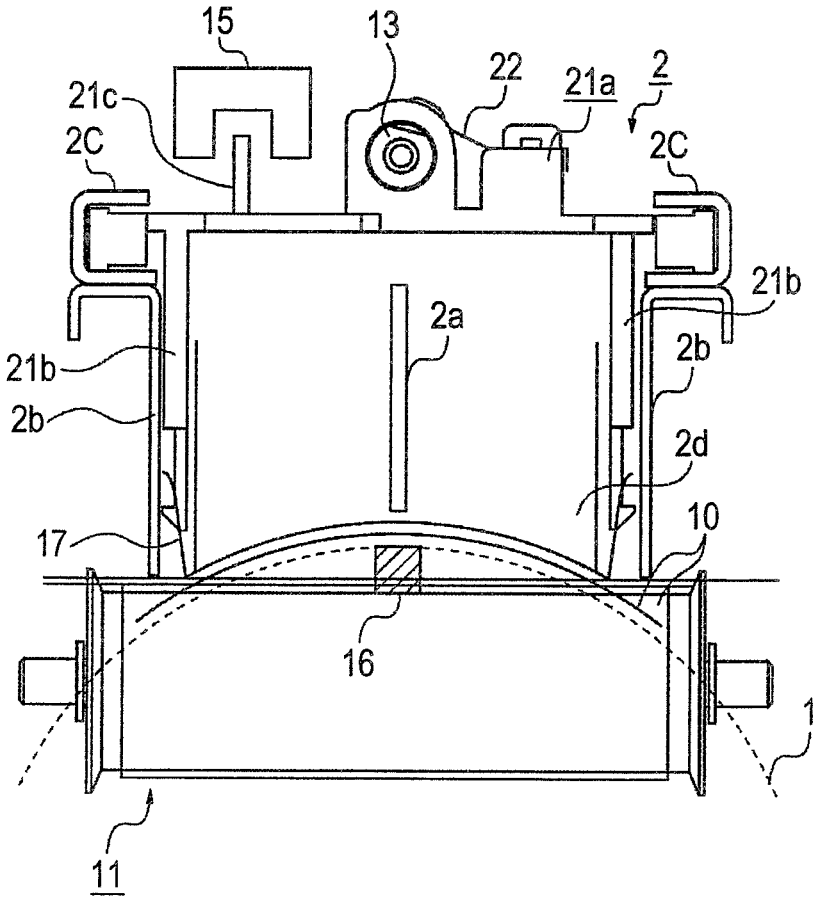
FIG. 10 is a schematic view of a charging device according to the present invention.

In addition, as illustrated in FIG. 10, the grid electrode 2*a* is arranged along the circumferential surface of the photosensitive member so that a central portion thereof in the widthwise direction (a moving direction for the photosensitive member) becomes more distant from the photosensitive member than the both end portions. Therefore, the corona charger 2 can be set nearer to the photosensitive member 1 than that in the conventional image forming apparatus, which can improve charging efficiency. The corona charger 2 is connected with a charging bias application power source S1 for applying a charging bias thereto, and has a function of uniformly charging the surface of the photosensitive member 1 to a potential of negative polarity at a charging position (a) by the charging bias applied from the application power source S1.

Specifically, the electric discharge wires 2*h* and the grid electrode 2*a* are configured so that the charging bias of a DC voltage is applied thereto. Furthermore, the corona charger 2 in the present example is provided with a charger shutter for preventing an electric discharge product produced by charging from depositing on the photosensitive member 1. The configuration of this charger shutter will be described in detail later.

Exposure Device

The exposure device 3 is a laser beam scanner provided with a semiconductor laser for irradiating the photosensitive member 1 charged by the corona charger 2 with a laser light L. The surface of the photosensitive member 1 which has been subjected to the charging treatment is exposed to the laser light L at an exposure position (b) along a main scan direction.

By repeating the exposure along the main scan direction while the photosensitive member 1 rotates, an electric potential of a portion irradiated with the laser light L out of the charged surface of the photosensitive member 1 is lowered, and an electrostatic latent image is formed which corresponds to the image information. Here, the main scan direction means a direction parallel to the generatrix of the photosensitive member 1 and a sub-scan direction means a direction parallel to the rotative direction of the photosensitive member 1.

Developing Device

The developing device 4 deposits a developer (toner) on the electrostatic latent image formed on the photosensitive member 1 by the charging device 2 and the exposure device 3 to visualize the latent image. The developing device 4 adopts a two-component magnetic brush developing method and a reverse developing method.

A developing container 4*a* and a non-magnetic developing sleeve 4*b* are illustrated, and the developing sleeve 4*b* is rotatably arranged in the developing container 4*a* while exposing a part of an outer peripheral surface thereof to the outside. There are provided a magnet roller 4*c* which is inserted into the developing sleeve 4*b* and is unrotatably fixed therein, a developer coating blade 4*d*, a two-component developer 4*e* which is accommodated in the developing container 4*a*, a developer-stirring member 4*f* which is disposed on the bottom side in the developing container 4*a*, and a toner hopper 4*g* which accommodates a toner for replenishment therein.

The developing sleeve 4*b* is rotationally driven at the developing portion (c) in a reverse direction (a direction indicated by an arrow R4) to the advancing direction of the photosensitive member 1. A part of the two-component developer 4*e* in the developing container 4*a* is adsorbed and retained as a magnetic brush layer on the outer peripheral surface of the developing sleeve 4*b* by a magnetic force of the magnet roller 4*c* in the developing sleeve, is rotationally transported along with the rotation of the developing sleeve, is regulated to a predetermined thin layer by the developer coating blade 4*d*, contacts the surface of the photosensitive member 1 at the developing portion (c), and adequately rubs the surface of the photosensitive member 1.

A developing bias application power source S2 is connected to the developing sleeve 4*b*. Then, the toner in the developer carried on the surface of the developing sleeve 4*b* is selectively deposited on the position corresponding to the electrostatic latent image on the photosensitive member 1 by an electric field generated by the developing bias applied by the developing bias application power source S2. In this way, the toner in the developer is coated onto the surface of the rotating developing sleeve 4*b* in a form of a thin layer, is transported to the developing portion (c), and is selectively deposited on the surface of the photosensitive member 1 so as to correspond to the electrostatic latent image by an electric field due to the developing bias. Then, the electrostatic latent image is developed as a toner image. In the case of the present example, the toner deposits on a light portion after the exposure of the surface of the photosensitive member 1, and the electrostatic latent image is reversely developed.

Transfer Device

The transfer device (transfer roller) 5 is pressed against the surface of the photosensitive member 1 with a predetermined pressing force, and the press nip portion becomes a transfer portion (d). To the transfer portion (d), the recording material P (paper or a transparent film, for instance) is fed from a sheet-feeding cassette at predetermined controlled timing.

While the recording material P fed to the transfer portion (d) is sandwiched and transported between the photosensitive member 1 and the transfer roller 5 which rotates in a direction indicated by an arrow R5, the toner image on the photosensitive member 1 is transferred to the recording material P. At this time, to the transfer roller 5, a transfer bias (+2 kV in the present example) having reverse polarity to the normal charging polarity (negative polarity) for the toner is applied from a transfer bias application power source S3.

Fixing Device

The fixing device 6 has a pressure roller 6*a* and a fixing roller 6*b*. The recording material P onto which the toner image has been transferred by the transfer device is transported to the fixing device 6, and is heated and pressed between the pressure roller 6*a* and the fixing roller 6*b*. Then, the toner image is fixed on the surface of the recording material P. The recording material P which has been subjected to the fixing treatment is then discharged to the outside of the apparatus.

Cleaning Device

The cleaning device 8 has a cleaning blade. Untransferred toner on the photosensitive member 1 surface, which remains after the toner image has been transferred onto the recording material P by the transfer device, is removed by the cleaning blade 8.

Optical Discharging Device

The optical discharging device 9 has a discharging exposure lamp. Electric charges remaining on the surface of the photosensitive member 1 which has been subjected to the cleaning treatment by the cleaning device 8 are removed by being irradiated with a light emitted from the discharging exposure lamp 9.

As described above, each image forming device finishes a series of the image forming process and prepares for a subsequent image forming action.

Detailed Configuration of Charging Device

Next, the configuration of a charging device according to the present invention will be described in detail below.

Charger Shutter

Figure 3:
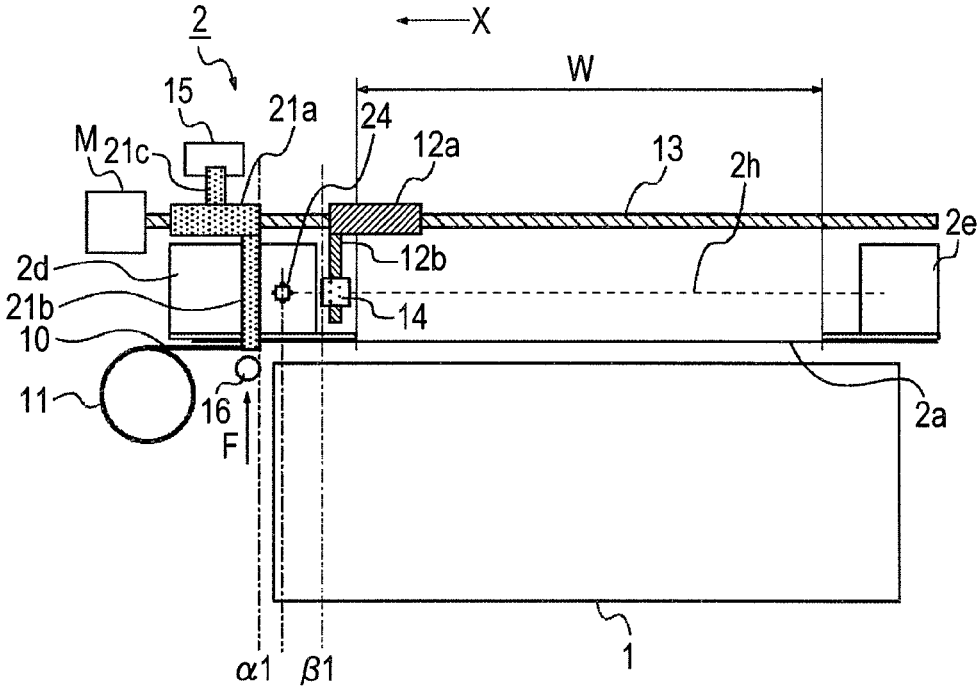
FIG. 3 is a view illustrating an opened state of a charger shutter according to the present invention.
Figure 4:
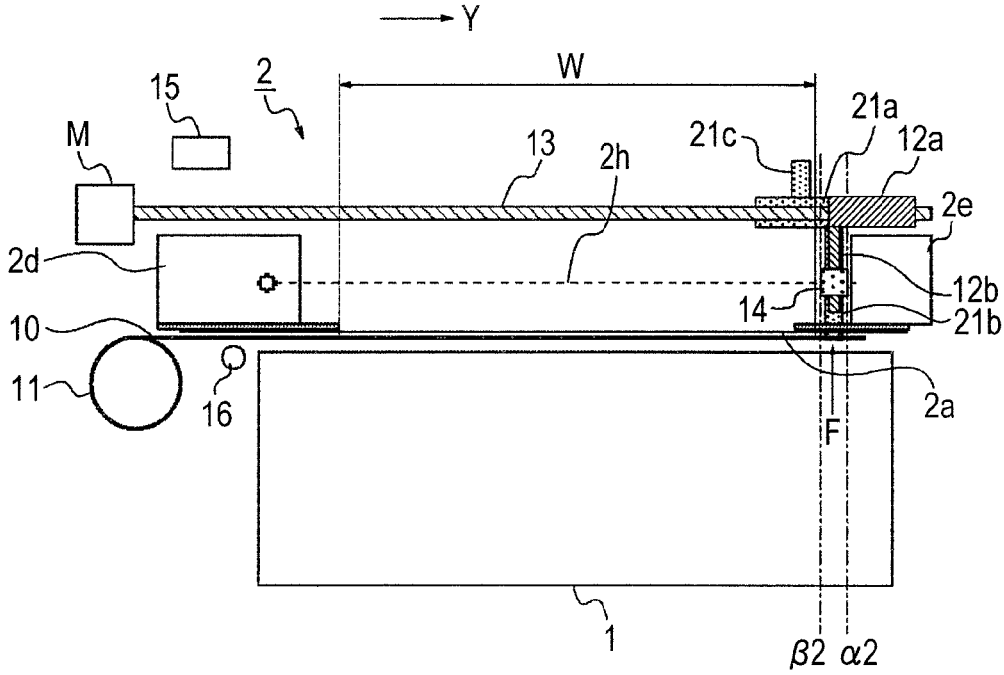
FIG. 4 is a view illustrating a closed state of a charger shutter according to the present invention.

A charger shutter 10 working as a sheet-shaped member which opens and closes the opening of the corona charger 2 will be now described below. FIGS. 3 and 4 illustrate an opened state and a closed state of the charger shutter 10, respectively. The opening of the corona charger 2 means an opening formed in the shield, and corresponds to a region (W of FIG. 3) to be charged by the corona charger 2. Accordingly, the region W to be charged by the corona charger approximately matches a region in which the photosensitive member 1 can be charged.

FIG. 3 illustrates a state in which the charger shutter 10 working as the sheet-shaped member is opened by being wound in order to move toward the X direction (opening direction). FIG. 4 illustrates a state in which the charger shutter 10 working as the sheet-shaped member is closed by being pulled in order to move toward the Y direction (closing direction).

As is illustrated in FIGS. 3 and 4, a sheet-shaped shutter (hereinafter referred to as a charger shutter) having an end, which can be wound in a roll shape by a winding device 11, is adopted as the charger shutter for opening and closing the opening of the corona charger 2. This is not only for the purpose of preventing the passage of an electric discharge product which falls from the corona charger 2 toward the photosensitive member 1, but also by the following reason.

Specifically, this is for preventing the photosensitive member 1 from receiving such a damage as to cause the deterioration of the image even when the charger shutter has contacted the photosensitive member 1 by any chance, because the charger shutter 10 moves through a narrow gap between the photosensitive member 1 and the grid electrode 2*a*. Specific materials of the charger shutter 10 used in the present exemplary embodiment will be described in detail later. In addition, the reason why the charger shutter 10 is configured to retract in a roll shape toward one end side of the longitudinal direction (main scan direction) of the charger 2 during an image forming action is to reduce a space for accommodating the charger shutter 10 which has retracted (in an opened period).

Driving Mechanism for Charger Shutter

Next, the opening/closing mechanism (moving mechanism) for the charger shutter 10 will be described below.

Figure 5:
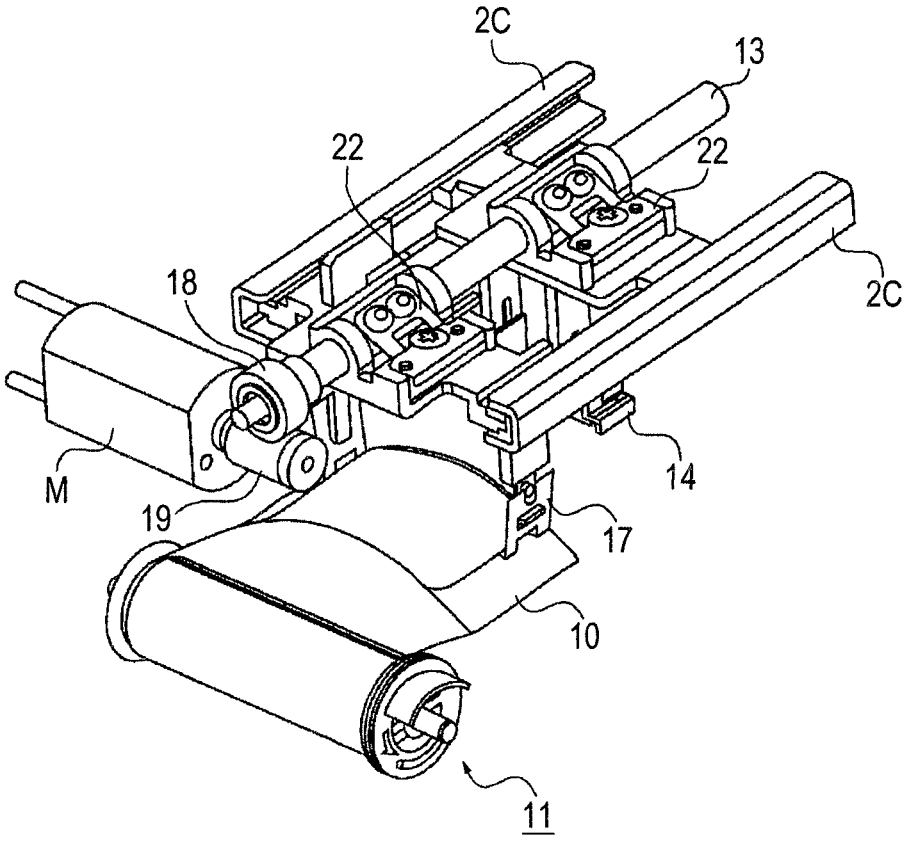
FIG. 5 is an explanatory view of an opening/closing mechanism of a charger shutter.

FIG. 5 is a perspective view illustrating details of an opening/closing mechanism, and FIG. 10 illustrates a cross section viewed from one end side in the longitudinal direction of a corona charger. This opening/closing mechanism has a driving motor M, the winding device 11, a first movable member 21*a* which holds the charger shutter 10, a second movable member 12*a* which holds a cleaning member 14, and a rotative member 13. By these devices, the charger shutter 10 can move along its longitudinal direction (main scan direction) to be opened or closed.

As is illustrated in FIGS. 3 and 10, a shutter-detecting device 15 is provided which detects the completion of an opening action of the charger shutter 10. This shutter-detecting device 15 has a photo-interrupter. When the first movable member 21*a* arrives at the opening action completion position, a shielding member 21*c* shields the light directing toward the photo-interrupter 15, and the shutter-detecting device detects the completion of the opening action of the charger shutter 10 by using the above condition. In other words, the shutter-detecting device 15 is configured so as to stop the rotation of the driving motor M at the time when having detected the shielding member 21*c* of the first movable member 21*a*.

Figure 7:
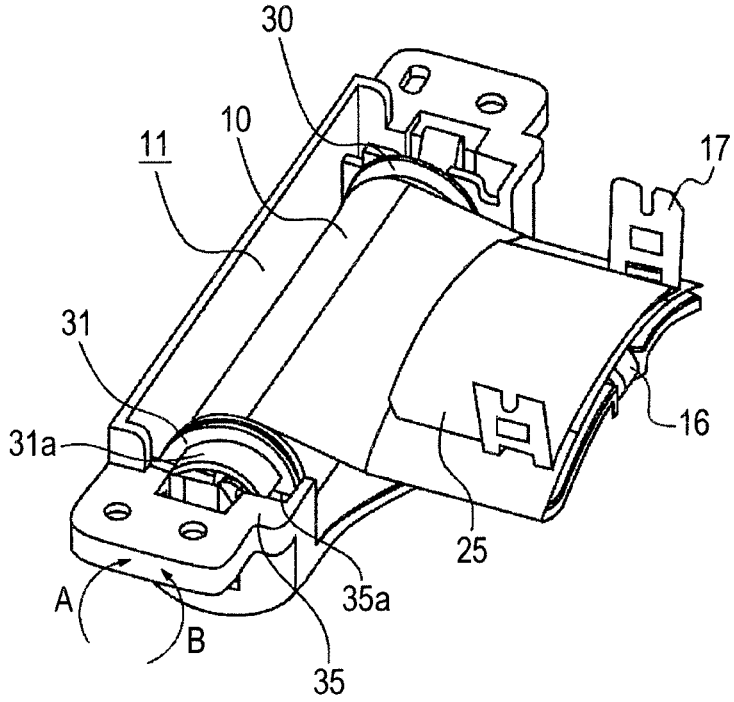
FIG. 7 is a schematic perspective view illustrating a state in which a winding device is set in a guide member.

As is illustrated in FIGS. 5 and 7, a shutter-fixing member 17 is provided on the tip side in the closing direction of the charger shutter 10, which functions as a regulating unit for regulating the shape of the charger shutter so that a central portion in a widthwise direction of the charger shutter more protrudes toward the corona charger side than both ends thereof. This shutter-fixing member 17 is locked and fixed by a connecting member 21*b* which is integrally provided on the first movable member 21*a*.

In addition, the first movable member 21*a* and the second movable member 12*a* have a drive-transmitting member 22 provided so as to be threadably mounted on the rotative member 13, and are connected to the rotative member 13 through this drive-transmitting member 22 to be driven. Furthermore, the first movable member 21*a* and the second movable member 12*a* are threadably mounted so as to be movable only in the main scan direction on a rail 2C provided on the corona charger 2, and thus being prevented from rotating together with the rotative member 13.

In addition, the rotative member 13 has a spiral groove formed thereon, and a gear 18 is connected to one end portion of the rotative member. On the other hand, a worm gear 19 is connected to the tip of the driving motor M, and transmits a driving force of the driving motor M to the rotative member 13 through a portion at which the worm gear 19 is engaged with the gear 18. When the rotative member 13 is rotationally driven by the driving motor M, the first movable member 21*a* and the second movable member 12*a* move in the main scan direction (X or Y direction) along this spiral groove. Accordingly, when the rotative member 13 is driven by the driving motor M, the force of moving the charger shutter 10 in the opening and closing direction is configured so as to be transmitted to the charger shutter through the connecting member 21*b* which is formed integrally with the first movable member 21*a*.

The second movable member 12*a* is integrally provided with a connecting member 12*b* which holds the cleaning member 14 for cleaning the electric discharge wire 2*h*. Accordingly, when the charger shutter 10 is moved by the driving motor M in the main scan direction (X or Y direction) as was described above, the cleaning member 14 also moves in the same direction simultaneously. Thereby, the cleaning member 14 for cleaning the electric discharge wire 2*h* and the charger shutter 10 can be driven by the same driving motor M.

Winding Mechanism for Charger Shutter

Next, a winding mechanism for the charger shutter 10 will be described below.

Figure 6:
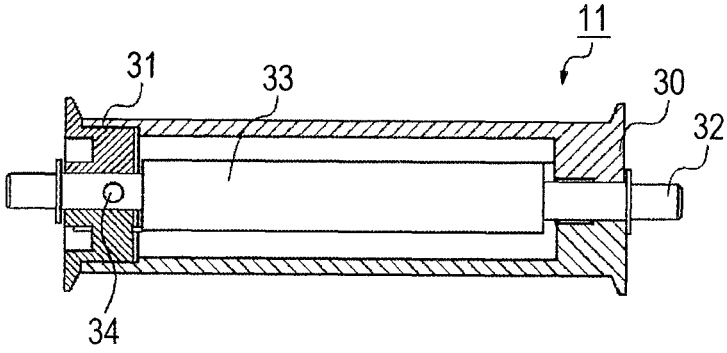
FIG. 6 is a schematic sectional view of a winding device.

FIG. 6 illustrates the configuration of the winding device 11 working as a winding unit. FIG. 7 illustrates a state in which the winding device 11 is equipped on a guide-fixing member 35 for attaching the winding device 11 to the corona charger 2.

The winding device 11 has a cylindrical winding roller (winding member) 30 for fixing one end side of the charger shutter 10 and also for winding the charger shutter 10, a shaft member 32 for supporting the winding roller 30 through the shaft, and a bearing member 31 for supporting the other end of the winding roller 30 through the shaft. The winding device 11 further has a parallel pin 34 which is a fixing member for fixing the bearing member 31 and the shaft member 32, and a spring (urging member) 33 which is arranged in the winding roller 30 and is engaged with the winding roller 30 and the bearing member 31.

In addition, the winding device 11 is configured so that the projection 31*a* of the bearing member 31 abuts on a rib 35*a* of the guide-fixing member by being attached on the guide-fixing member 35, as is illustrated in FIG. 7. Thereby, the bearing member 31 and the shaft member 32 are fixed in a non-rotatable manner, and only the winding roller 30 is rotatably supported through the shaft. When being attached on the guide-fixing member, the winding device 11 is attached in a state in which the bearing member 31 is wound several times in the B direction in a state in which the winding roller 30 is fixed, before being attached on the guide-fixing member 35, in order that a rotative force in the A direction is generated in the bearing member 31. Thereby, when the winding device 11 is pulled in the direction (X direction) of opening the charger shutter 10, a torsional force of the spring 33 works in the direction in which the winding roller 30 winds the charger shutter 10. At this time, the bearing member 31 receives a force working in the A direction, and accordingly abuts on the guide-fixing member 35 to be fixed in a non-rotatable manner.

In addition, in order to prevent the winding device 11 from being slacked when moving in the direction of opening the charger shutter 10, it is necessary to previously impart such a winding force as not to slack the charger shutter 10 onto the winding device 11.

In the present example, the winding force of the winding device 11 becomes weakest at a position in which the charger shutter 10 has moved to the opening action completion position, as illustrated in FIG. 3. For this reason, the number of rotating the bearing member 31 in the B direction before the winding device is attached on the guide-fixing member 35 is determined with the winding force at this position being the lower limit of such a winding force as not to slack the charger shutter 10. Accordingly, the winding roller 30 is structured so as to wind the charger shutter 10 at any time while preventing the charger shutter 10 from being slacked downward along with the movement of the charger shutter 10 to the X direction by the driving motor M, when the charger shutter is opened (FIG. 3).

On the other hand, the charger shutter 10 is structured so as to move to the Y direction by such an action of the driving motor M as to pull the charger shutter 10 from the winding roller 30 against the urging force of the spring 33 in the winding roller 30, when the charger shutter 10 is closed (FIG. 4). Note that, when the charger shutter 10 is in a state of being completely closed, the charger shutter 10 is not slacked downward because the spring 33 in the winding roller 30 exerts the urging force toward the X direction on the charger shutter 10. Accordingly, because the gap is hardly formed between the charger shutter 10 and the corona charger 2 when the charger shutter 10 is closed, the charging device can maintain the state in which the corona discharge product is less liable to leak to the outside.

Movement Range of Charger Shutter

The movement distances of the charger shutter 10 and the cleaning member 14 are changed by using the first movable member 21*a* and the second movable member 12*a*. The first movable member 21*a* and the second movable member 12*a* stop at respective opening positions α1 and β1, in a state in which the charger shutter 10 is opened, as is illustrated in FIG. 3.

The opening positions α1 and β1 are positions at which the shutter-detecting device 15 for detecting the completion of an opening action of the charger shutter 10 detects the first movable member 21*a* and has stopped the opening action. In addition, α shows a tip position of the charger shutter 10, β shows an end surface in the winding side of the cleaning member 14, and α1 and β1 at the opening positions are set so as to be closer to the winding side than to the electric discharge region W.

Furthermore, the second movable member 12*a* stops at the stop position 31 at which the whole cleaning member 14 is closer to the winding side than to the electric discharge region W, as is illustrated in FIG. 3. In contrast to this, the first movable member 21*a* stops at the stop position ∀1 at which the first movable member 21*a* is closer to the winding side than a wire threading member 24 of the electric discharge wire 2*h*. Thus, by setting ∀1 in a side closer to the winding side than to the wire threading member 24, in other words, by setting ∀1 in a side closer to the winding side than to the ∃1, the electric discharge wire 2*h* results in being capable of being exchanged even without removing the charger shutter 10.

Furthermore, the opening position α1 of the first movable member 21*a* is set in a side closer to the winding side than to an end surface in the winding side of the photosensitive member 1, and thus the charger shutter 10 is configured so as not to contact the photosensitive member 1 even when the photosensitive member 1 rotates during a normal operation.

When the charger shutter 10 is closed, the first movable member 21*a* and the second movable member 12*a* move to the Y direction in a state of keeping the space between them set at the opening position. Then, the first movable member 21*a* and the second movable member 12*a* abut on a block 2*e* in the back side, and stop at the closing positions α2 and β2, as illustrated in FIG. 4. After a predetermined time has passed after the movable members have started the movement, the motor M stops driving and the closing action of the charger shutter 10 ends. When the charger shutter 10 is opened, the first movable member 21*a* and the second movable member 12*a* keep the state in the closing time, and move to the X direction in a state of closely contacting each other.

Then, the second movable member 12*a* abuts on a block 2*d* in the front side, the first movable member 21*a* abuts on a shield plate, and the movable members stop at the respective opening positions α1 and β1, as illustrated in FIG. 3. At this time, the shutter-detecting device 15 detects the first movable member 21*a*, stops the motor M, and finishes the opening action.

Positioning Configuration for Charger Shutter

Next, the positioning configuration for the charger shutter 10 will be described below.

Figure 9:
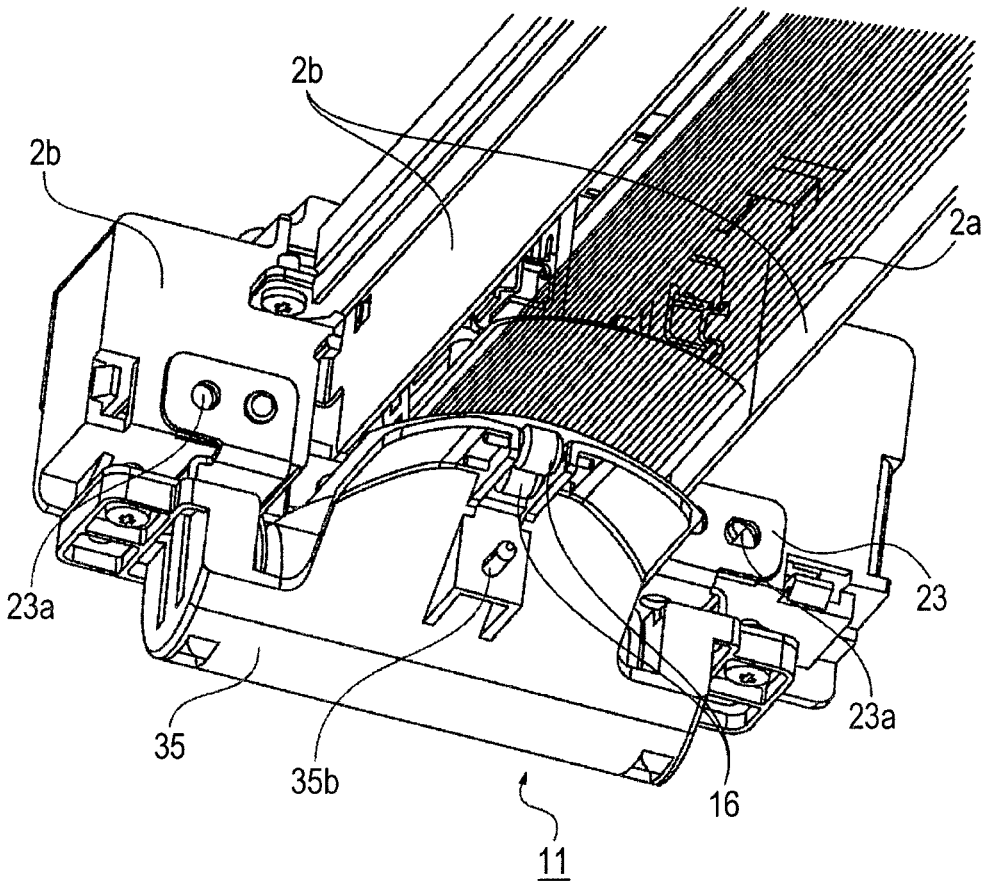
FIG. 9 is a perspective view illustrating a positioning member of a charger.

FIG. 9 is a perspective view illustrating a positioning member 23 for use in attaching the corona charger 2 to the main body of the apparatus. When the apparatus is assembled, the corona charger 2 causes flexure due to a tension generated when the grid electrode 2*a* is stretched, and when the corona charger 2 is attached to the main body of the apparatus, gaps between the photosensitive member 1 and the grid electrode 2*a* may be different in its longitudinal direction. If the difference between the gaps is large, the difference causes the density difference in a main scan direction of the resultant output product.

In order to prevent the density difference in such a main scan direction, in the present example, the corona charger 2 in which the grid electrode 2*a* has been stretched has a mechanism which measures the front and the back heights of the grid electrode 2*a*, and adjusts the height difference in the front side against the back side to 50 μm or less. Specifically, the corona charger is configured so as to guarantee the accuracy by adjusting the positioning member 23 against the block 2*d* in the front side when assembling them. The positioning member 23 is provided with the guide-fixing member 35 which holds the charger shutter 10. Furthermore, the guide-fixing member 35 is provided with a projection 35*b* for guaranteeing the position accuracy of a guide member 16 and the photosensitive member 1. This projection 35*b* and a positioning hole 23*a* of the positioning member 23 are configured so as to be positioned in each positioning member provided on a not-illustrated member for positioning the photosensitive member 1 of the main body of the apparatus, respectively. Thereby, the photosensitive member 1, the corona charger 2 (grid electrode 2*a*), and the guide-fixing member 35 (guide member 16) are configured so as to be positioned in the same member accurately.

Curvature Shape Imparting Mechanism for Charger Shutter

In the corona charger 2 in the present example, as was described above, the grid electrode 2*a* is arranged along the circumferential surface of the photosensitive member 1 so that a central portion thereof in the widthwise direction (a circumferential direction of the photosensitive member) becomes more distant from the photosensitive member 1 than the both end portions. Therefore, in the present example, the charger shutter 10 also is provided with a curvature shape imparting mechanism as a regulating unit so that the shape of the charger shutter 10 substantially follows (corresponds to) the curvature shape of the circumferential surface of the photosensitive member 1. In the present example, the charger shutter 10 has a curvature shape imparting mechanism for the tip of the charger shutter 10 and a curvature shape imparting mechanism for the charger shutter 10 in a winding port side, as the curvature shape imparting mechanism, and the mechanisms will be sequentially described below.

Curvature Shape Imparting Mechanism for Tip of Charger Shutter 10

Firstly, a curvature shape imparting mechanism for the tip of the charger shutter 10 will be described below.

Figure 8A:
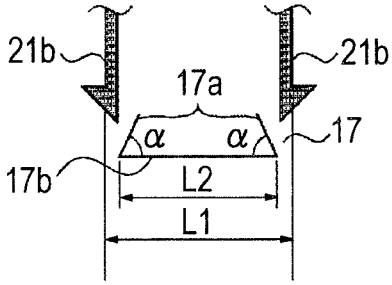
FIGS. 8A and 8B are views illustrating a state of a shutter-fixing member.
Figure 8B:
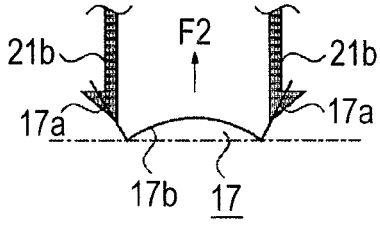

FIG. 10 is a sectional view of a corona charger when the corona charger is viewed from its widthwise direction, and FIG. 8A or FIG. 8B is a view illustrating a state (FIG. 8A) before the shutter-fixing member 17 working as a regulating member is attached to the connecting member 21*b*, and a state (FIG. 8B) after the shutter-fixing member has been attached. As illustrated in FIG. 10, the shutter-fixing member 17 for fixing the charger shutter 10 to the movable member 21*a* is attached to one end side in the longitudinal direction of the charger shutter 10, which exists in the outside of the range for the charger shutter 10 to be wound by the winding device 11. This shutter-fixing member 17 is constituted by a member having such elasticity as to follow the curvature shape of the circumferential surface of the photosensitive member 1 when having been attached to the connecting member 21*b*. Specifically, as illustrated in FIG. 8A, the shutter-fixing member 17 is set so that a width L2 (before elastic deformation) of a thin metal sheet having spring properties is smaller than a width L1 of an attaching portion of the connecting member 21*b*. The attaching portion 17*a* of the shutter-fixing member 17 to the connecting member 21*b* is set so that an angle α formed by the attaching portion 17*an* and a attaching face 17*b* for fixing the rear face (a face in a corona charger side) of the charger shutter 10 is 90° or less (45° in the present example). Thereby, the shutter-fixing member 17 elastically deforms when having been attached to the connecting member 21*b*, as illustrated in FIG. 8B, and receives a force F2 which acts toward a direction of departing from the photosensitive member 1. For this reason, the charger shutter 10 forms such a curvature shape that a central portion of the shutter-attaching face 17*b* in the widthwise direction more protrudes than both end portions thereof, and the curvature shape can be imparted to the tip of the charger shutter 10.

Curvature Shape Imparting Mechanism for Charger Shutter 10 in Winding Port Side In the present example, as illustrated in FIGS. 9 and 10, a rotating body which is a guide member 16 and is so-called a roller is provided in the winding port side of the winding device 11 for the charger shutter 10, as a second curvature shape imparting mechanism. This guide member 16 is different from the shutter-fixing member 17, is rotatably supported by the guide-fixing member 35, and has such a structure so as to guide the charger shutter 10 while rotating in the opening and closing movement. Accordingly, the guide member 16 can prevent the load necessary for the opening and closing movement for the charger shutter 10 from increasing when regulating the charger shutter 10 so as to form a desired curvature shape.

In addition, the guide member 16 is arranged at a position which is outside the winding range of the winding member 11 and is closer to the winding member 11 than to the photosensitive member 1. In addition, the top part of the roller which is the guide member 16 is positioned at a position closer to the corona charger 2 side than to the closest position (outer peripheral surface of photosensitive member 1) of the photosensitive member 1 to the corona charger 2, and the charger shutter 10 has such a relationship as to slide on the guide member 16 during the opening and closing action. In addition, the guide member 16 is arranged only in the central portion in the widthwise direction of the corona charger 2, and is configured so as to impart the curvature shape to the charger shutter 10 similarly to the shutter-fixing member 17. Furthermore, the guide member 16 has also a function of leading the charger shutter 10 to a fine gap between the grid electrode 2*a* and the photosensitive member 1 as a shutter-inserting guide. Therefore, the charger shutter 10 can maintain such a shape that the central portion in its widthwise direction more protrudes toward the corona charger 2 side than both end portions thereof, even in the side for the charger shutter 10 to be wound by the winding device 11. By imparting such a shape to the charger shutter 10, the charger shutter 10 contributes to reduce the gap between the corona charger 2 (grid electrode 2*a*) and the photosensitive member 1 as much as possible. Note that, the curvature shape of the charger shutter 10 does not necessarily need to be matched with the curvature shape of the circumferential surface of the photosensitive member 1 as long as the curvature shape is within such a range as not to cause a problem in the opening and closing action for the charger shutter.

Tip-Protecting Member of Charger Shutter

Next, a protective sheet 25 which is a tip-protecting member of the charger shutter 10 will be described below. FIG. 7 is a schematic view illustrating the tip side of the charger shutter in the present example, and FIGS. 3 and 4 illustrate the opened state and the closed state of the charger shutter 10 in the present example.

In the present example, the corona charger 2 has a curvature as described above, and the shutter-fixing member 17 formed of an elastic member is provided at the tip of the charger shutter 10. When this shutter-fixing member 17 is attached to the connecting member 21*b*, the shutter-fixing member 17 is elastically deformed, and generates an urging force F2 toward such a direction that the shutter-fixing member becomes more distant from the photosensitive member 1, as illustrated in FIG. 8B. The urging force F2 works so as to always press the charger shutter 10 against the charging block 2*d* or the grid electrode 2*a*, so as to maintain the curvature. Therefore, the portion of the charger shutter 10 attached to the shutter-fixing member 17 has such a relationship as to be always rubbed by the charging block 2*d* or the grid electrode 2*a*. Thereby, the charger shutter 10 results in being worn out by the rubbing action. In order to prevent the wearing, in the present example, the thin sheet-shaped protective sheet 25 is provided in a side (grid electrode 2*a* side) of the shutter-fixing member opposite to the side at which the charger shutter 10 is located, as illustrated in FIG. 7. This protective sheet 25 is formed of a film member of polyethyleneterephthalate (PET) with the thickness of 50 μm so as not to prevent the shutter-fixing member 17 from acquiring the curvature. By this protective sheet 25, the charger shutter 10 is prevented from being directly rubbed by the grid electrode 2*a* and the charging block 2*d* due to the urging force F of the shutter-fixing member 17, and can be prevented from being worn out. In addition, the protective sheet 25 is provided outside the range in which the charger shutter 10 is wound by the winding member 11 (state of FIG. 5), in the shutter-opened state illustrated in FIG. 3. For this reason, even if the protective sheet 25 is provided on the charger shutter 10, the winding property of the charger shutter 10 can not be impaired.

In addition, in the present example, the PET film having elasticity has been taken as the example of the material of the protective sheet 25, but the material of the protective sheet 25 is not limited to a resin sheet as long as the protective sheet does not hinder the urging force F2 necessary for the shutter-fixing member 17 to generate the curvature and is a material strong against rubbing.

In the above example, the case was described in which the corona charger was used for substantially uniformly charging the photosensitive member in a process prior to a process of forming an electrostatic image on the photosensitive member. In addition to the above case, the present invention can be applied similarly to the case as well in which the corona charger is used for subjecting a toner image which has been formed on the photosensitive member to charging treatment. In addition, in the above example, the case was described in which the grid electrode was provided at the opening of the corona charger, but the present invention can be applied similarly to the case as well in which the grid electrode is not provided in the corona charger.

Experimental Example 1

Evaluation Method for Amount of Adsorbed Material Originating from Electric Discharge Product onto Charger Shutter A charger shutter member with the thickness of 250 μm formed from a material shown in the following Table 1 was mounted in the charging device of the above described image forming apparatus, as a charger shutter.

Then, images corresponding to 5,000 sheets of paper with the A4 size were output in 8 hours under the environment of the temperature of 30° C. and the relative humidity of 80%, while the state of FIG. 3 was kept. After that, the charger shutter member was left at rest for 16 hours in the state of FIG. 4. Such operations of outputting the images and leaving the charger shutter member at rest were repeated until the total number of the sheets of the output image reached 1 million sheets.

The charging region by the corona charger 2 in the present Experimental Example was 322 mm in the longitudinal direction (W in FIG. 3) and was 44 mm in the rotative direction, and the amount of an electric discharge product adsorbed onto the shielding member under the charging region was measured. The amount of the electric discharge product adsorbed onto the charger shutter was measured in the following way. Specifically, the amount of the electric discharge product was measured by charging 141.7 $cm^2$ of the charger shutter under the above described charging region into 50 ml of pure water, leaving the charger shutter at rest for 12 hours under the environment of the temperature of 30° C. and the relative humidity of 80%, and measuring the quantity of ions originating from the electric discharge product ($No_2^-$ and $NO_3^-$), which have dissolved into the pure water, with ion chromatography.

In addition, image deletion was evaluated by using an image forming apparatus equipped with charger shutters formed from various types of materials, and the swelling and deformation of fibers which constitute the charger shutter were evaluated. The evaluation result of the image deletion and an evaluation method for the swelling and deformation of the fibers are shown below. The results are shown in Table 1 and Table 2.

Evaluation Method for Image Deletion

At the time points when the above described image output for the durability test arrived at 250,000 sheets, 500,000 sheets and 1 million sheets, the shielding member was left at rest under the environment of the temperature of 30° C. and the relative humidity of 80% for 16 hours, in the state of FIG. 4. After that, the state of the shielding member was changed to the state of FIG. 3, and the images of a character chart and a half-tone chart were output. The obtained image was evaluated according to the following criteria.

A: characters can be distinguished and image deletion does not occur also in the half-tone chart.

B: characters can be distinguished, but image deletion occurs in a half-tone chart.

C: characters cannot be distinguished and image deletion also occurs in a half-tone chart.

Evaluation Method for Swelling and Deformation of Fibers

At the time point when the above described image output for the durability test arrived at 1 million sheets, the shielding member was left at rest under the environment of the temperature of 30° C. and the relative humidity of 80% for 16 hours in the state of FIG. 4 and the amount of the deformation was then measured and evaluated according to the following criteria.

A: the variation of fibers in the shielded region due to the swelling and deformation is 10% or less of the value before the durability test.

B: the variation of fibers in the shielded region due to the swelling and deformation is 20% or less and more than 10% of the value before the durability test.

C: the variation of fibers in the shielded region due to the swelling and deformation is more than 20% of the value before the durability test.

TABLE 1

| | | Number of sheets for durability test | | | | | | |
|---|---|---|---|---|---|---|---|---|
| | | 250,000 Sheets | | 500,000 Sheets | | 1 Million sheets | | |
| Shielding member | Official moisture regain (%) | Ion quantity (ppm) | Image deletion | Ion quantity (ppm) | Image deletion | Ion quantity (ppm) | Image deletion | Swelling and deformation of fibers |
| Polyethylene (PE) woven fabric | 0.0 | 3.1 | A | 12.4 | C | 49.2 | C | A |
| PET nonwoven fabric | 0.1 | 2.6 | A | 10.5 | B | 42.1 | C | A |
| Polyester nonwoven fabric | 0.4 | 1.8 | A | 7.0 | B | 28.3 | C | A |
| Polyester (irregular-shaped cross section) nonwoven fabric | 0.8 | 0.8 | A | 3.4 | A | 13.5 | C | A |
| Polyurethane sheet | 1.0 | 0.8 | A | 3.1 | A | 12.3 | C | A |
| Acryl woven fabric | 2.0 | 0.6 | A | 2.4 | A | 9.5 | B | A |
| Nylon nonwoven fabric | 4.5 | 0.4 | A | 1.5 | A | 6.0 | B | A |
| Acetate nonwoven fabric | 6.5 | 0.3 | A | 1.2 | A | 4.7 | A | A |
| Cotton nonwoven fabric | 8.5 | 0.2 | A | 1.0 | A | 3.9 | A | A |
| Rayon nonwoven fabric | 11.0 | 0.1 | A | 0.6 | A | 2.3 | A | A |
| Wool | 15.0 | 0.1 | A | 0.5 | A | 2.0 | A | B |
| Acrylate-based fiber | 20.0 | 0.1 | A | 0.5 | A | 1.9 | A | C |

It is understood from Table 1 that as an official moisture regain increases, the quantity of the detected ions originating from the electric discharge product decreases. In addition, FIG. 1 is a graph illustrating the relationship between the quantity of the ions originating from the electric discharge product measured from the charger shutter after images of 1 million sheets have been output and the official moisture regain of the charger shutter material.

It is understood from FIG. 1 that when the official moisture regain of the charger shutter material is below 2.0(%), the quantity of the ions originating from the electric discharge product increases rapidly, and image deletion occurs in an electrophotographic image. From the result, a technical meaning of using highly hygroscopic fibers having an official moisture regain an official moisture regain of 2.0% or more as the charger shutter can be recognized. On the other hand, when the official moisture regain exceeded 15.0(%), swelling and deformation occurred in the fibers.

Experimental Example 2

The same evaluation as in Experimental Example 1 (however, except for evaluation for "swelling and deformation of fibers") was conducted by using an image forming apparatus that used respective shielding members formed from the materials and having the forms shown in Table 2. The results are shown in Table 2.

In addition, the quantities of the ions originating from the electric discharge product are both 2.6 ppm in the cases when 250,000 sheets of paper were output from the apparatus using a PET nonwoven fabric (Experimental Example 2-4) and when 500,000 sheets of paper were output from the apparatus using a nylon film (Experimental Example 2-7). However, in the Experimental Example having employed the fibrous PET, image deletion did not occur in the half-tone chart, and in the Experimental Example having employed nylon of the film base material, image deletion occurred in the electrophotographic image. This is considered to be caused by the difference of the base material form. Specifically, the fibrous material does not adhere to the photosensitive member compared to the film base material. Therefore, it is considered that the substances originating from the electric discharge product (nitric acid and the like) which has deposited on the fiber is gradually decomposed by the air having intervened on the contact surface, and the amount of the substance originating from the electric discharge product which has been transferred from the shutter or the amount of the substance originating from the electric discharge product remaining on the photosensitive member has decreased.

TABLE 2

| | | | Number of sheets for durability test | | | | | |
|---|---|---|---|---|---|---|---|---|
| | | | 250,000 Sheets | | 500,000 Sheets | | 1 Million sheets | |
| Experimental Example No. | Shielding member | Official moisture regain (%) | Ion quantity (ppm) | Image deletion | Ion quantity (ppm) | Image deletion | Ion quantity (ppm) | Image deletion |
| 2-1 | PE film | 0.0 | 3.5 | B | 14.0 | C | 55.3 | C |
| 2-2 | PE woven fabric | 0.0 | 3.1 | A | 12.4 | C | 49.2 | C |
| 2-3 | PET film | 0.1 | 3.0 | B | 12.0 | C | 48.2 | C |
| 2-4 | PET nonwoven fabric | 0.1 | 2.6 | A | 10.5 | B | 42.1 | C |
| 2-5 | Acrylic film | 2.0 | 1.0 | A | 4.0 | B | 16.3 | C |
| 2-6 | Acryl woven fabric | 2.0 | 0.6 | A | 2.4 | A | 9.5 | B |
| 2-7 | Nylon film | 4.5 | 0.6 | A | 2.6 | B | 10.4 | B |
| 2-8 | Nylon nonwoven fabric | 4.5 | 0.4 | A | 1.5 | A | 6.0 | B |

As shown in Table 2, it is understood that the amounts of the electric discharge products detected from the nonwoven fabrics and woven fabrics employed as the base material form of the material constituting the charger shutter in Experimental Examples 2-2, 2-4, 2-6 and 2-8 decrease compared to those detected from films employed as the base material form in Experimental Examples 2-1, 2-3, 2-5 and 2-7.

Experimental Example 3

The same evaluation as in Experimental Example 2 was conducted by using an image forming apparatus that used respective PET films as the charger shutter, which had the thickness of 250 μm and had various metals shown in Table 3 vapor-deposited or plated thereon. The results are shown in Table 3.

TABLE 3

| Experimental Example No. | Shielding member | Number of sheets for durability test: 250,000 Sheets Ion quantity (ppm) | 250,000 Sheets Image deletion | 500,000 Sheets Ion quantity (ppm) | 500,000 Sheets Image deletion | 1 Million sheets Ion quantity (ppm) | 1 Million sheets Image deletion |
|---|---|---|---|---|---|---|---|
| 3-1 | PET film | 3.0 | B | 12.0 | C | 48.2 | C |
| 3-2 | Aluminum vapor-deposited PET film | 0.4 | A | 1.6 | B | 6.3 | B |
| 3-3 | Zinc vapor-deposited PET film | 0.4 | A | 1.6 | B | 6.5 | B |
| 3-4 | Tin vapor-deposited PET film | 0.4 | A | 1.7 | B | 6.9 | B |
| 3-5 | Lead vapor-deposited PET film | 0.4 | A | 1.8 | B | 7.2 | C |
| 3-6 | Brass-plated PET film | 0.6 | A | 2.3 | B | 9.1 | B |
| 3-7 | Bronze-plated PET film | 0.6 | A | 2.4 | B | 9.5 | B |
| 3-8 | Copper vapor-deposited PET film | 0.7 | A | 2.7 | B | 10.8 | B |
| 3-9 | Iron vapor-deposited PET film | 1.0 | A | 3.8 | B | 15.3 | C |
| 3-10 | Nickel vapor-deposited PET film | 1.0 | A | 4.0 | B | 16.2 | C |
| 3-11 | Stainless sheet | 2.5 | B | 9.9 | B | 39.8 | C |
| 3-12 | Glass sheet | 4.7 | B | 18.8 | C | 75.4 | C |
| 3-13 | Ceramic sheet | 4.2 | B | 16.9 | C | 68.0 | C |

As shown in Table 3, it is understood that the quantities of the detected ions originating from the electric discharge product in Experimental Examples 3-2 to 3-10 decrease compared to those in Experimental Examples 3-1 and 3-11 to 3-13.

Note that, the charger shutter used in Experimental Examples 3-11 to 3-13 were difficult to wind in the configuration of the charger shutter, because of the material used as the charger shutter. Therefore, the charger shutters were evaluated by repeating the operations of: when closing the charger shutter, removing the charger once after the image-forming operation has been finished, then installing the charger shutters so as to cover the photosensitive member placed under the charger, and returning the charger to the original position; and when opening the charger shutter, conducting the reverse actions to the above actions.

In addition, it is understood that the amounts of the detected electric discharge products in Experimental Examples 3-2 to 3-7 decrease compared to those in Experimental Examples 3-9 to 3-10. From these results, it can be recognized that it is advantageous to use, as a metal or an alloy for a shielding member, one which can form a metallic salt by combining with a nitrate ion and does not form a passive state to nitric acid.

In addition, although aluminum is generally said to form the passive state to nitric acid, the amount of the detected electric discharge product is small compared to that on iron and nickel. This is considered to be because even though being a metal which forms the passive state, the metal forms such a state as is difficult to form the passive state, because water supplied from the air always intervenes in a highly humid environment. Furthermore, this is considered to be because aluminum, among others, has a strong metal ionization tendency and is easier to combine with nitric acid than iron and nickel.

From the above results, it is understood that even though a shielding member is a film material, the performance can be improved to such a level that after 1 million sheets of images have been output, the image deletion which occurs in an electrophotographic image becomes slight and characters can be distinguished, by making the shielding member include a metal or an alloy which can form a metallic salt by combining with a nitrate ion.

Experimental Example 4

The same evaluation as in Experimental Example 2 was conducted by using an image forming apparatus that used respective PET nonwoven fabrics as the charger shutter, which had the thickness of 250 μm and were coated with metal hydroxides shown in Table 4. The results are shown in Table 4.

TABLE 4

| Experimental Example No. | Shielding member | Number of sheets for durability test: 250,000 Sheets Ion quantity (ppm) | 250,000 Sheets Image deletion | 500,000 Sheets Ion quantity (ppm) | 500,000 Sheets Image deletion | 1 Million sheets Ion quantity (ppm) | 1 Million sheets Image deletion |
|---|---|---|---|---|---|---|---|
| 4-1 | PET nonwoven fabric | 2.6 | A | 10.5 | B | 42.1 | C |
| 4-2 | Aluminum-hydroxide-coated PET nonwoven fabric | 0.4 | A | 1.5 | A | 5.9 | B |
| 4-3 | Zinc-hydroxide-coated PET nonwoven fabric | 0.4 | A | 1.6 | A | 6.3 | B |

TABLE 4-continued

| Experimental Example No. | Shielding member | Number of sheets for durability test: 250,000 Sheets Ion quantity (ppm) | 250,000 Sheets Image deletion | 500,000 Sheets Ion quantity (ppm) | 500,000 Sheets Image deletion | 1 Million sheets Ion quantity (ppm) | 1 Million sheets Image deletion |
|---|---|---|---|---|---|---|---|
| 4-4 | Tin-hydroxide-coated PET nonwoven fabric | 0.4 | A | 1.6 | A | 6.6 | B |
| 4-5 | Lead-hydroxide-coated PET nonwoven fabric | 0.4 | A | 1.6 | A | 6.6 | B |
| 4-6 | Copper-hydroxide-coated PET nonwoven fabric | 0.4 | A | 1.7 | A | 6.8 | B |

As shown in Table 4, the quantities of the detected ions originating from the electric discharge product in Experimental Examples 4-2 to 4-5 decreased compared to that in Experimental Example 4-1. This is considered to be caused by such a property that the metal hydroxide is generally difficult to dissolve in water but dissolves in nitric acid. Specifically, the metal hydroxide of the charger shutter is oxidized by water in the air, and the metal in the metal hydroxide reacts with the nitric acid which has been produced on the charger shutter to produce the metal salt. Therefore, it is considered that the metal hydroxide can produce the metal nitrate for a long period of time, and can suppress the migration of the nitric acid to the photosensitive member for a long period of time.

In addition, the metal hydroxides used in Experimental Examples 4-2 to 4-6 efficiently react with a nitrate ion and can produce the metal salts. Because of this, it is considered that the metal hydroxides could convert the nitric acid produced on the charger shutter into the metal salts efficiently.

From the above results, it is understood that by making the shielding member include the metal hydroxide, the performance is improved to such a level that the image deletion which occurs in an electrophotographic image becomes slight and characters can be distinguished, after 1 million sheets of images have been output even when a substrate to be coated with the metal hydroxide does not have the effect of adsorbing the electric discharge product.

Experimental Example 5

The same evaluation as in Experimental Example 2 was conducted by using an image forming apparatus that used respective PET nonwoven fabrics as the charger shutter, which had the thickness of 250 μm and were coated with metal sulfides shown in Table 5. The results are shown in Table 5.

TABLE 5

| Experimental Example No. | Shielding member | Number of sheets for durability test: 250,000 Sheets Ion quantity (ppm) | 250,000 Sheets Image deletion | 500,000 Sheets Ion quantity (ppm) | 500,000 Sheets Image deletion | 1 Million sheets Ion quantity (ppm) | 1 Million sheets Image deletion |
|---|---|---|---|---|---|---|---|
| 5-1 | PET nonwoven fabric | 2.6 | A | 10.5 | B | 42.1 | C |
| 5-2 | Aluminum-sulfide-coated PET nonwoven fabric | 0.4 | A | 1.4 | A | 5.7 | B |
| 5-3 | Zinc-sulfide-coated PET nonwoven fabric | 0.5 | A | 1.8 | A | 7.3 | B |
| 5-4 | Tin-sulfide-coated PET nonwoven fabric | 0.6 | A | 2.4 | A | 9.5 | B |
| 5-5 | Lead-sulfide-coated PET nonwoven fabric | 0.5 | A | 1.9 | A | 7.5 | B |
| 5-6 | Copper-sulfide-coated PET nonwoven fabric | 0.4 | A | 1.5 | A | 6.2 | B |

As shown in Table 5, the quantities of the detected ions originating from the electric discharge product in Experimental Examples 5-2 to 5-6 decreased compared to that in Experimental Example 5-1. This is considered to be caused by such a property that the metal sulfide is generally difficult to dissolve in water but dissolves in nitric acid. Specifically, the metal sulfide is oxidized by water in the air, the metal in the metal sulfide well reacts with the nitric acid which has been produced on the charger shutter to produce the metal salt. Because of this, it is considered that the metal sulfide could convert the nitric acid into the metal salt for a long period of time, and alleviate influences which the nitric acid gives to the photosensitive member.

In addition, it is considered that the metal sulfides used in Experimental Examples 5-3 to 5-6 efficiently combine with a nitrate ion to produce the metal salt in addition to having the above described property of the metal sulfide, and accordingly could more efficiently convert the nitric acid produced on the shielding member into the metal salt.

Furthermore, the aluminum sulfide used in Experimental Example 5-2 has a property different from a general property of a metal sulfide, but changes to aluminum hydroxide by being hydrolyzed in a high humidity environment. As a result, it is considered that the same effect as that due to the property of the metal hydroxide can be obtained.

From the above results, it is understood that by making the shielding member include the metal sulfide, the performance is improved to such a level that the image deletion which occurs in an electrophotographic image becomes slight and characters can be distinguished, after 1 million sheets of images have been output even when a substrate to be coated with the metal sulfide does not have the effect of adsorbing the electric discharge product.

Experimental Example 6

The same evaluation as in Experimental Example 2 was conducted by using an image forming apparatus that used respective PET nonwoven fabrics as the charger shutter, which had the thickness of 250 μm and were coated with materials shown in Table 6. The results are shown in Table 6.

TABLE 6

| | | Number of sheets for durability test | | | | | |
|---|---|---|---|---|---|---|---|
| | | 250,000 Sheets | | 500,000 Sheets | | 1 Million sheets | |
| Experimental Example No. | Shielding member | Ion quantity (ppm) | Image deletion | Ion quantity (ppm) | Image deletion | Ion quantity (ppm) | Image deletion |
| 6-1 | PET nonwoven fabric | 2.6 | A | 10.5 | B | 42.1 | C |
| 6-2 | Red-phosphorus-coated PET nonwoven fabric | 0.3 | A | 1.3 | A | 5.2 | A |
| 6-3 | Phosphate ester-coated PET nonwoven fabric | 0.4 | A | 1.4 | A | 5.8 | B |

As shown in Table 6, it is understood that the amounts of the detected electric discharge products in Experimental Examples 6-2 and 6-3 decrease compared to that in Experimental Example 6-1. This is considered to be caused by the following mechanism. Specifically, red phosphorus or the phosphate ester reacts with the nitric acid to be oxidized, and the oxidized product combines with water to produce phosphoric acid, polymetaphosphoric acid or the like. Then, the products cause a dehydration reaction with a molecular chain of those materials in the charger shutter to produce water, and a nitrogen oxide (NOx) permeates not only into the surface of the charger shutter but also into the inner part of the charger shutter to produce nitric acid. It is considered that as a result, the charger shutter could maintain the capability of adsorbing the nitric acid for a long period of time, and could suppress influences which the nitric acid gives to the photosensitive member for a long period of time.

From the above results, it is understood that by making the shielding member include phosphorus or the phosphate ester, the performance is improved to such a level that the image deletion does not occur in an electrophotographic image or even if the image deletion occurs, the image deletion becomes slight and characters can be distinguished, after 1 million sheets of images have been output even when a substrate to be coated with the phosphorus or the phosphate ester does not have the effect of adsorbing the electric discharge product.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-052024, filed Mar. 9, 2010, which is hereby incorporated by reference herein in its entirety.

What is claimed is:

1. A charging device comprising:

an image bearing member which bears an image thereon;

a charging member which charges said image bearing member;

a shielding member which shields said image bearing member from said charging member; and a grid electrode, wherein said shielding member is provided so as to shield between said image bearing member and said grid electrode, and wherein said shielding member comprises any material selected from the group consisting of the following (i) to (iv):

(i) a metal or an alloy which can produce a metal salt by combining with a nitrate ion, selected from the group consisting of aluminum, zinc, tin, copper, brass and bronze;

(ii) a metal hydroxide;

(iii) a metal sulfide; and (iv) phosphorus or a phosphate ester.

2. The charging device according to claim 1, wherein said shielding member comprises the material of (i).

3. The charging device according to claim 1, wherein said shielding member comprises the material of (ii), and said material is at least one selected from the group consisting of aluminum hydroxide, zinc hydroxide, tin hydroxide, lead hydroxide and copper hydroxide.

4. The charging device according to claim 1, wherein said shielding member comprises the material of (iv), and said material is red phosphorus.

5. The charging device according to claim 1, wherein said shielding member is configured so as to retract towards one end side of the longitudinal direction of said charging member.

6. The charging device comprising:

an image bearing member which bears an image thereon;

a charging member which charges said image bearing member; and a shielding member which shields said image bearing member from said charging member, wherein said shielding member comprises at least one material selected from the group consisting of aluminum sulfide, zinc sulfide, tin sulfide, lead sulfide and copper sulfide.

* * * * *